United States Patent [19]

Marks et al.

[11] 3,994,786

[45] Nov. 30, 1976

[54] ELECTROPLATING DEVICE AND METHOD

[75] Inventors: Richard Lee Marks, Warren; Gwynne Isaac Edson, Russell. both of Pa.

[73] Assignee: GTE Sylvania Incorporated, Stamford, Conn.

[22] Filed: June 13, 1975

[21] Appl. No.: 586,556

[52] U.S. Cl. ..... 204/28; 204/206; 204/275

[51] Int. Cl.[2] ..... C25D 7/06; C25D 17/00

[58] Field of Search ..... 204/28, 206, 207, 208, 204/209, 210, 211, 275

[56] References Cited

UNITED STATES PATENTS

| | | | |
|---|---|---|---|
| 1,065,090 | 6/1913 | Werth | 204/206 |
| 3,549,507 | 12/1970 | Semienko et al. | 204/28 |
| 3,592,753 | 7/1971 | Semienko et al. | 204/206 |
| 3,644,181 | 2/1972 | Donaldson | 204/15 |
| 3,865,701 | 2/1975 | Borgmann | 204/28 |
| 3,894,924 | 7/1975 | Toledo | 204/206 |

OTHER PUBLICATIONS

Def. Pub. T868,001, A. J. Avila et al., Nov. 18, 1969. (pp. 4–11 of the spec. included).

*Primary Examiner*—G. L. Kaplan
*Attorney, Agent, or Firm*—Norman J. O'Malley; Lawrence R. Fraley; Donald R. Castle

[57] ABSTRACT

There is described an electroplating method and device for accomplishing the same whereby metal plating is disposed on a wire as said wire moves along an established path through the device. Relatively high speed deposition is achieved as a result of intermittent positioning of the device's inlet and outlet ports within the electrically conductive means of the device. The wire to be plated is established at a negative electrical potential and moved through said electrically conductive means. Accordingly, the conductive means is adapted for providing the electrolyte therein with a positive electrical potential to thereby provide the desired deposition.

14 Claims, 9 Drawing Figures

ELECTROPLATING DEVICE AND METHOD

BACKGROUND OF THE INVENTION

This invention relates to electroplating and particularly to high speed electroplating of a metal or alloy of metals on a moving wire. Even more particularly, this invention relates to high speed electroplating wherein uniform distribution of the electrolyte solution against the moving wire is achieved.

Initial efforts for accomplishing wire electroplating included passing the wire through a spaced series of open troughs which contained a quantity of electrolyte therein. Multiple passes were usually required in addition to providing a means for agitating the solutions in the troughs. In addition to being inefficient by manufacturing standards, the described method often resulted in produced wire having several areas of nonuniformity in the plating thicknesses.

In more recent years, the trend has been toward plating of moving wire at substantially higher rates with the result being, of course, improved productivity. Accordingly, the main emphasis in designing the plating devices or cells which accomplish this plating has been toward providing relatively high turbulence or agitation of the electrolyte solution within the device. The primary function of turbulence or agitation in such a device is to hopefully reduce the thickness of the cathode "depletion layer". This undesirable layer, usually of micron thickness, develops at the cathode solution interface and is characterized by a depletion of the required metallic ion within the electrolyte. As can be appreciated, reducing the thickness of this depletion layer is considered essential in order to achieve successful electroplating.

As can further be appreciated, successful high speed plating requires relatively high current densities per square foot of wire to assure a durable plate on the wire. To date, the best known devices capable of providing a relatively high level of electrolyte agitation have only been capable of providing current densities of approximately 500 amperes per square foot of moving wire. Such densities are considered too low for satisfactory high speed plating of wire.

It is therefore believed that a device and method capable of providing relatively high current densities in addition to high levels of agitation to the electrolyte would constitute an advancement in the art.

OBJECTS AND SUMMARY OF THE INVENTION

It is an objective of the present invention to provide a device and method for uniformly electroplating a moving wire.

It is an even further objective of this invention to provide a device and method capable of electroplating a moving wire at higher plating rates than known in the prior art.

In accordance with one aspect of this invention there is provided a device for electroplating a wire established at a negative electrical potential and moving along an established path. The device comprises a housing including first and second manifold means and a common passageway for moving said wire therethrough. The first manifold means comprises a plurality of spacedly positioned inlet means having access to the common passageway for providing the passageway with electrolyte. A second manifold means includes a plurality of spacedly positioned outlet means intermittently oriented with respect to the inlet means and capable of removing electrolyte from within the common passageway. Positioned within the passageway and substantially about the established path of travel of the wire is an electrically conductive means. The conductive means includes a plurality of arrays of entrance ports and a plurality of arrays of exit ports. The arrays of entrance ports align with each of the inlet means for receiving the electrolyte and the arrays of exit ports align with the outlet means for removal of electrolyte.

In accordance with another aspect of this invention there is provided a method for electroplating a moving wire established at a negative electrical potential. The method utilizes a device having a housing with a common passageway therein and an electrically conductive means located within the common passageway. The steps of the method include supplying the device with a continuous flow of electrolyte at an established pressure, moving the wire at a predetermined rate through the electrically conductive means within the passageway, applying electrical energy to the conductive means in order that the electrolyte will be of positive electrical potential compared to that of the wire, and removing the electrolyte from within the electrically conductive means.

DESCRIPTION OF THE PREFERRED EMBODIMENTS

For a better understanding of the present invention, together with other and further objects, advantages and capabilities thereof, reference is made to the following disclosure and appended claims in connection with the above described drawings.

Figure 1:
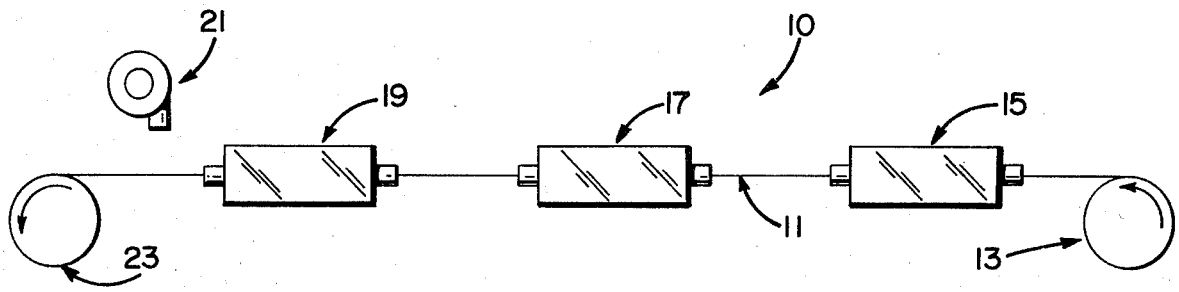
FIG. 1 is a plan view of an electroplating system.

With particular reference to FIG. 1, there is illustrated an electroplating system 10 capable of high speed electroplating a wire 11 moving along an established path. System 10 comprises a supply means, illustrated as a spool 13, a cleaning means 15, a plating means 17, a rinsing means 19, a drying means 21, and a takeup means, illustrated as a spool 23. Cleaning means 15 serves to remove any contaminants or similar undesirable impurities from wire 11 as the wire is withdrawn from supply spool 13. Plating means 17 is then adapted for electroplating wire 11 with a predetermined thickness of a metal or alloy of metals. After plating is achieved, rinsing means 19 serves to rinse any excessive by-products of the previous plating process from the moving wire. Drying means 21 then serves to substantially dry the wire prior to takeup on spool 23. A drive means (not shown) for system 10 can be located in proximity to spool 23 to in turn drive this spool to achieve the desired takeup function.

Means 13, 21, and 23 are representative of several types of components which could provide the functions described. For example, instead of utilizing a hot air drying means as illustrated for drying means 21, a wiping mechanism or similar device could be employed. As is understood, devices which are capable of providing the functions for means 13, 21, and 23 are well known in the art and therefore do not constitute the inventive concepts of the proposed present invention. It is further understood that similar substitutions could be made for cleaning means 15 and rinsing means 19 in that several of these devices are well known in the electroplating art. However, as will be described, a unique feature of the present invention is its ability to not only provide the desired plating function but also its ready capability for providing the cleaning and rinsing functions in system 10. That is, the electroplating device of the present invention can readily serve in all three capacities as illustrated in FIG. 1.

Figure 2:
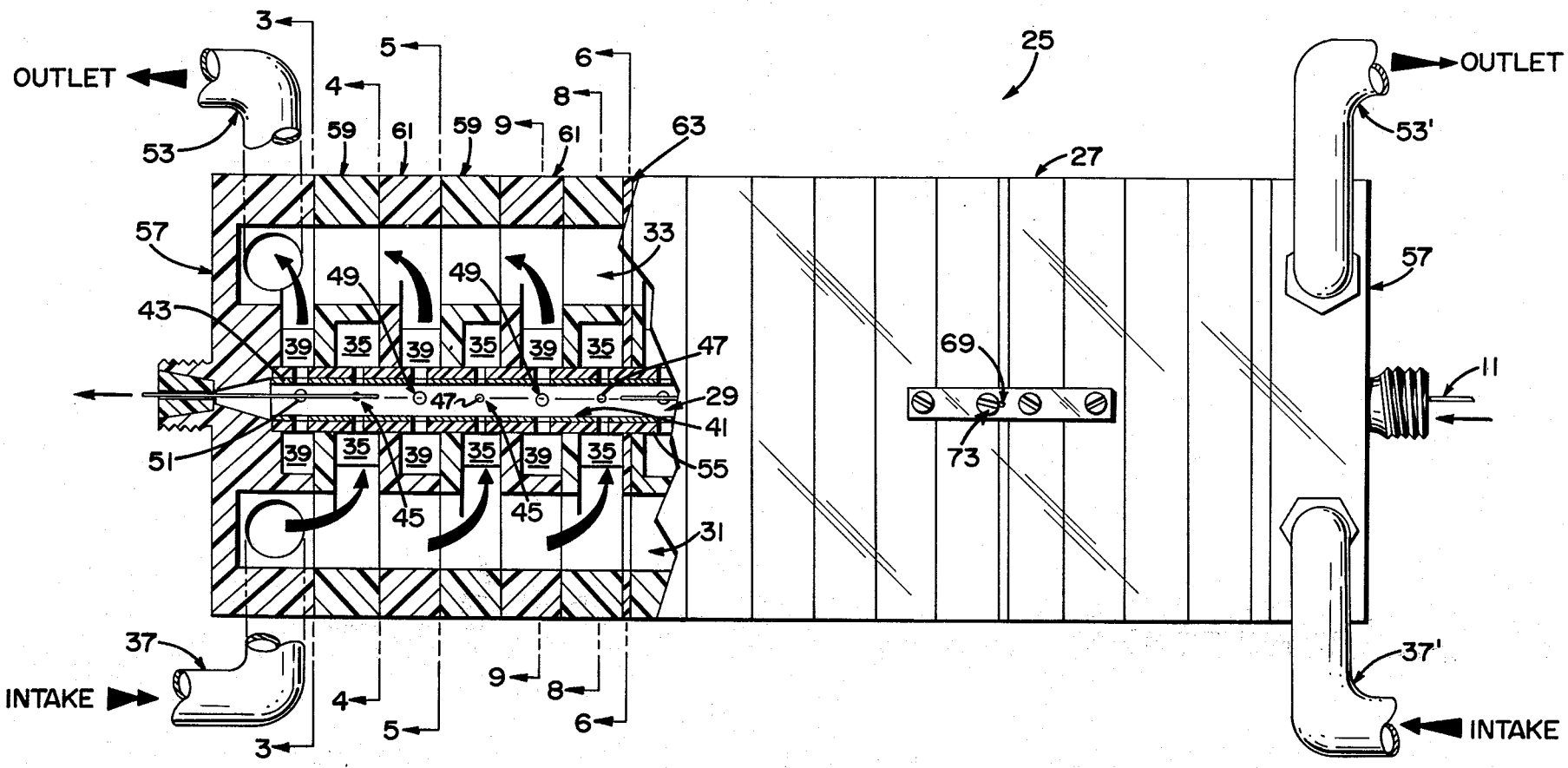
FIG. 2 is a side elevational view, partly in section, of an electroplating device in accordance with a preferred embodiment of the present invention.

In FIG. 2, there is illustrated an enlarged view of a plating device 25 capable of providing the plating function of plating means 17 in the system of FIG. 1. Electroplating device 25 is illustrated as comprising a housing 27 of electrically insulative material (preferably plastic) which includes therein a common passageway 29, first manifold means 31, and second manifold means 33. Common passageway 29 is adapted for having wire 11 move therethrough in the manner and direction indicated. Accordingly, first manifold means 31 comprises a plurality of spacedly positioned inlet means 35 each of which have access to common passageway 29. As illustrated, each of the inlet means 35 are spacedly positioned along common passageway 29 and are therefore adapted for providing passageway 29 with electrolyte solution as supplied through a pair of opposing intake members 37 and 37′. As will be described, plating device 25 is fully capable of electroplating wire 11 with a uniform plating thickness of a metal or alloy of metals of both the precious and non-precious varieties. That is, wire 11 is capable of being plated with a precious metal such as gold or a non-precious metal such as nickel. The above are representative of but a few of the several metals or alloys of metals which are readily capable of being plated utilizing device 25. An example of a suitable precious metal electrolyte solution for use in device 25 is an acidified solution of gold salts. Several other electrolytes are of course acceptable and are well known in the electroplating field. Therefore, further description of such solutions is not considered necessary.

Although two members (37 and 37′) are illustrated for supplying device 25 with electrolyte solution, it is to be understood that only one is necessary to achieve satisfactory electroplating. It has been determined, however, that utilization of two opposingly positioned intake members more readily assures a substantially uniform pressure exerted against the electrolyte passing into inlet means 25.

Second manifold means 33 is illustrated as comprising a plurality of outlet means 39 spacedly positioned along common passageway 29 and adapted for having access thereto. As can further be seen in FIG. 2, each of the described outlet means is intermittently oriented in housing 27 with respect to the forementioned inlet means 35. This positioning relationship constitutes a significant feature of the present invention in that intermittent spacing of the described inlet and outlet means assures a uniform distribution of electrolyte solution against wire 11 moving through device 25. Additionally, this positioning relationship assures a uniform removal of spent electrolyte solution from within the common passageway once electroplating has been achieved. This unique feature assures relatively high plating rates as a result of substantially greater pressure distribution of the electrolyte solution entering and engaging wire 11 as well as its removal from the device.

Positioned within common passageway 29 is an electrically conductive means 41, illustrated as a tubular metallic member 43. Tubular member 43 is positioned within passageway 29 in such a manner that wire 11 will pass therethrough when passing through device 25. It is preferred that the central axis of the tubular metallic member be coincidental to the path of travel of wire 11 through device 25. As will be described (particularly in FIG. 8), this positioning relationship assures the uniform distribution of the electrolyte solution against the moving wire.

Wire 11, when passing through plating device 25, is established at a negative electrical potential. This potential is achieved by electrical engagement, i.e., roller contact, of the wire externally from device 25. Such an electrical contact is well known in the art and therefore does not constitute an inventive concept of the present invention. It is only necessary in the present invention, that wire 11 be established as a negative electrical potential when moving through device 25. Accordingly, it is the function of the electrically conductive means positioned within common passageway 29 to establish the electrolyte therein at a positive electrical potential opposite the potential of the wire. As is understood, the opposite polarities thus permit successful electroplating.

With further reference to FIG. 2, the electrically conductive tubular member 43 comprises a plurality of arrays 45 of entrance ports 47 and a plurality of arrays 49 of exit ports 51. Each array 45 of entrance ports 47 is aligned in common passageway 29 with the described inlet means 35 of first manifold means 31. Accordingly, each array 49 of exit ports 51 is aligned within passageway 29 with each of the outlet means 39 of second manifold means 33.

In the preferred embodiment of the invention, each array 45 of entrance ports 47 preferably comprises four ports. Additionally, each array 49 of exit ports 51 preferably comprises a total of four ports. As will be described in FIGS. 8 and 9, the four ports of each array of entrance and exit ports are preferably established at approximately 90° from each other with respect to the central axis of tubular member 43.

As illustrated in FIG. 2, each of the entrance ports in arrays 45 are smaller in cross sectional area than each of the exit ports in arrays 49. In the preferred embodiment of the invention, the entrance ports each have a diameter within the range of from about 0.050 to about 0.150 inches. Accordingly, the size of the wire 11 receiving electrical deposition is preferably within the range of from about 0.025 to about 0.075. It is to be understood, however, that the previously described diameter sizes for the intake ports are only preferable when accommodating a wire of the size mentioned. Electroplating device 25 is easily adapted for plating wires of much greater as well as much smaller diameters. It is preferred, however, that the diameters of the intake ports be approximately twice as large as the diameter of the wire being plated. This is only a preferred requirement, however, in that different ratios of intake port diameter to wire diameter can successfully be used.

In FIG. 2, each of the illustrated exit ports 51 are shown as being substantially larger than each of the corresponding entrance ports 47. This is considered an essential requirement of the plating device of the present invention in order to facilitate removal of the spent electrolyte within conductive means 41. Even further, it is preferred to utilize exit ports having an area at least twice that of the entrance ports 47. This again is a preferred range and is not meant to be restrictive with regard to the present invention.

The spent electrolyte removed from within conductive means 41 is passed out through exit ports 51 in the direction indicated and is caused to exit plating device 25 through a pair of opposingly positioned outlet members 53 and 53'. As with inlets 37 and 37', it is preferred to use at least two outlet members to provide the desired removal function. However, it is to be understood that only one outlet is necessary in order to achieve satisfactory results. As further shown in FIG. 2, the illustrated direction of exit for the electrolyte solution within the left-hand side of device 25 is toward outlet 53. Accordingly, the exiting direction for the electrolyte solution within the right side will be toward the outlet 53'. Thus it can be seen that removal is facilitated by use of at least two outlet members.

Though not illustrated, the electrolyte solution entering inlets 37 and 37' is supplied by an externally located supplying system, i.e., pump, holding tank, etc. Such a system is well known in the art and therefore does not constitute the inventive concept of the invention. Similarly, the exiting electrolyte passes from outlet members 53 and 53' to a recirculation means (not shown) and is preferably recirculated back to device 25 through the aforementioned externally located supply source.

In the preferred embodiment of the invention, electrolyte is supplied device 25 at an established pressure of about 20 to about 40 pounds per square inch. This supply is of continuous nature and is preferred in order to achieve successful uniform electroplating. When using the forementioned pressure, entrance and exit port diameters, and wire sizes, it is preferred to move wire 11 through device 25 at a rate within the range of about 200 to about 400 feet per minute. Additionally, utilization of current densities within the range of from about 1500 to about 12,000 amps per square foot of wire is possible. The previously described range is of course dependent on the metal or alloy of metals being plated. When using a wire consisting essentially of nickel and plating this wire with a thickness of approximately 50 millionths of an inch of a precious metal such as gold, it is preferred to utilize current densities within the range of from about 1,000 to about 2,100 amps per square foot of wire. Accordingly, when utilizing copper as the wire substrate, and plating this with nickel or an alloy of nickel, it is preferred to use current densities within the range of from about 10,000 to about 12,000 amps per square foot of moving wire.

In the device of FIG. 2, it is preferred to utilize platinum as the material for tubular metallic member 43. Of course other suitable electrically conductive materials may be utilized but platinum is preferred due to its high resistance to corrosion as well as its sound electrical conductive properties. In the preferred embodiment of the invention, the tubular electrically conductive means 43 is preferably positioned within an electrically insulative supportive means 55. Supportive means 55 provides the function of supporting the tubular metallic member 43 within the common passage 29. As can be understood, use of an electrically insulative supportive member as shown facilitates use of a tubular metallic member of substantially less thickness than would be required if no supportive means were used. Supportive means 55 includes a plurality of corresponding entrance and exit ports which align with the aforedescribed entrance and exit ports of tubular conductive member 43. Thus, electrolyte entering first manifold 31 passes through inlet means 35 and further through entrance ports 47 to therefor be uniformly distributed against moving wire 11. As can be seen in FIG. 2, entrance ports 47 provide a spraying or similar type motion for the electrolyte passing therethrough from the pressurized first manifold means 31. Solution within tubular conductive means 43 passes out through exit ports 51 and into the outlet means 39 of second manifold 33. It can therefore be seen that a complete circulation system is provided by device 25 in which the supplied electrolyte is uniformly distributed against a wire moving therethrough. Additionally, it has been shown that a highly efficient means of removal of the spent electrolyte solution from within the device has been provided.

Figure 3:
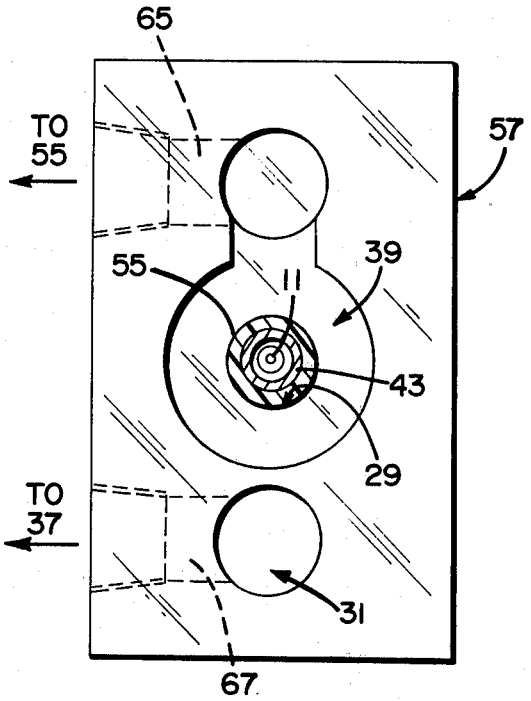
FIGS. 3–6 represent the various individual components which comprise the device of FIG. 2.

FIG. 3, taken along line 3—3 in FIG. 2, illustrates a preferred embodiment of the end portion 57 of plating device 25. With reference back to FIG. 2, the device is illustrated as comprising a series of individual component members 59 and 61 intermittently oriented with respect to the substantially centrally located electrically conductive means 41. Accordingly, affixed at each opposing end of device 25 are the forementioned end portions 57. Each end portion is substantially similar in configuration and therefore assures relatively low costs in manufacturing device 25. As will be described, each of the component members 59 and 61 are also substantially similar in configuration thereby further reducing production costs. In assembling device 25, the described conductive means 41 is positioned within supportive member 55 in the described aligned relationship. This assembled member is then positioned within one of the described end portions 57. Thereafter, each of the individual component members 59 and 61 is slidably positioned over supportive member 55 and joined in an engaged relationship by use of a suitable epoxy or similar cementing material. As will be described, periodically located within the device and in much the same manner as the positioning of components 59 and 61 are a plurality of spacer members 63. Description of these members and their function will be provided with the description of FIG. 6.

Referring back to FIG. 3, end portion 57 is illustrated as comprising one of the described outlet means 39. Outlet means 39 is illustrated as being a substantially circular channel which in turn is substantially located about the common passageway 29. As further illustrated in FIG. 3, located within common passageway 29 is the described supportive member 55. Within member 55 is the described electrically conductive tubular member 43. It can be seen in FIG. 3 that wire 11 moves through tubular member 43 at the approximate central axis of member 43. The spent electrolyte solution which passes from within member 43 to outlet means 39 passes substantially upward and out through an outlet chamber 65. This chamber in turn is joined to outlet member 53 and provides a means for escape of solution from device 25. Also illustrated in FIG. 3 is the main conducting passageway of first manifold 31. First manifold 31 also has an entrance passageway 67 which in turn is operatively joined to intake member 37. Each of these described outlet and intake members are not illustrated in FIG. 3 for reasons of clarity.

Figure 4:
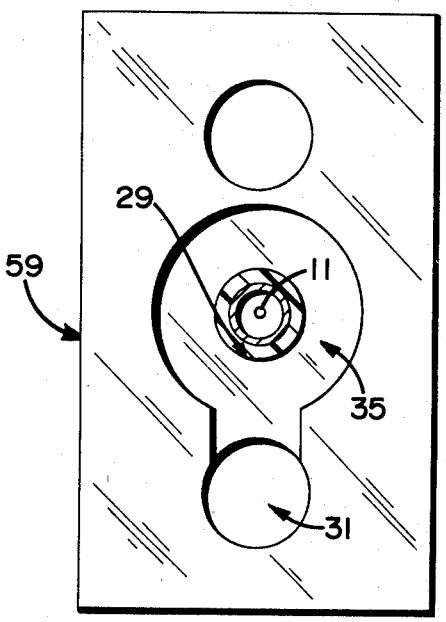

FIG. 4, taken along the line 4—4 in FIG. 2, represents an enlarged view of one of the component members 59 as positioned within device 25. Component member 59 includes therein the previously described inlet means 35. Similar to outlet means 39, inlet means 35 is preferably a substantially circular passage which is substantially located about common passageway 29. Accordingly, electrolyte solution entering the main conductive portion of first manifold 31 will pass up through and about circular passage 35. It can therefore be seen that electrolyte solution is passed completely about the tubular conductive means 43 in a uniform manner therefore assuring that solution passing into member 43 is done so in a uniform procedure. The position of wire 11 is also shown.

Figure 5:
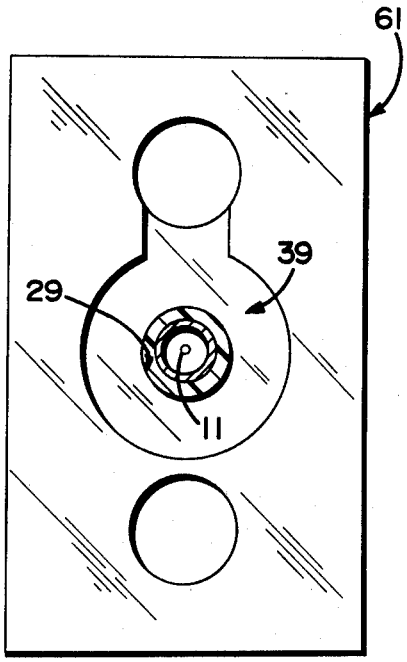

Component 61 as shown in FIG. 5 is substantially similar to component 59 shown in FIG. 4. However, component 61 is positioned in reversed manner from that of component 59 within device 25. That is, component 61 is inverted with respect to the positioning of component 59. Thus, it can be seen that utilization of substantially identical components for members 59 and 61 and positioning these components within the device in reversed manner results in a significant reduction in production costs for device 25. It must be remembered however that although it is illustrated in FIG. 2 that device 25 is comprised of several component portions joined together in a predetermined manner, that is not meant to be restrictive to the broad concept of the present invention. That is, a singular unitary housing could be successfully utilized with a plurality of passageways similar to those illustrated in FIG. 2 provided within the unitary housing. As stated, however, it is preferred to utilize the configuration illustrated as a means by which production costs may be significantly reduced.

With reference back to FIG. 5, component member 61 includes therein the forementioned outlet means 39 which completely encompasses the substantially centrally located common passage 29. Wire 11 is also shown in its preferred position.

Figure 6:
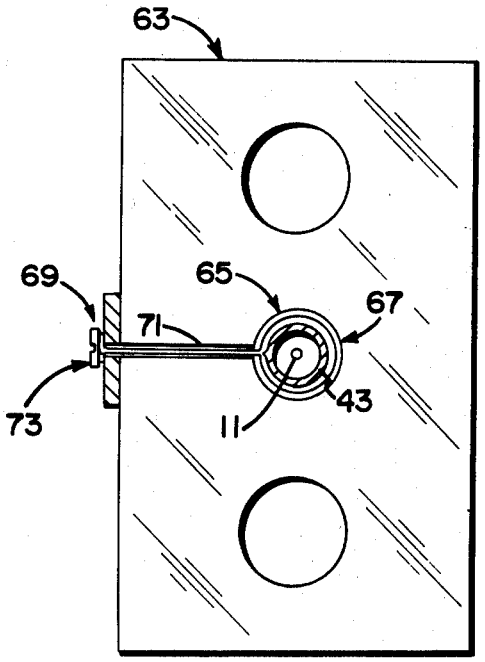

Illustrated in FIG. 6, taken along the line 6—6 in FIG. 2, is the forementioned spacer member 63. This member provides a spacing means in order that an electrical connection means 65 can be incorporated within the device 25. In the preferred embodiment of the invention, the electrical connection means 65 has first and second opposing end portions 67 and 69, respectively, with first end portion 67 being electrically joined to electrically conductive tubular member 43. In essence, electrical connection 65 means comprises an anode wire which at first end portion 67 is completely encircled in engaged relationship about tubular conductive means 43. Further, the opposing second end portion 69 is confined within a channeled slot 71 located within spacer 63. Thus, slot 71 serves to house the anode wire and provide a means whereby second portion 69 may be positioned externally from device 25. Each of the second end portions 69 is electrically joined to an external screw or similar capping means 73. This capping means, also illustrated in FIG. 2, provides a means whereby external electrical connections may be made to end portion 69. That is, an externally located power source can easily be joined electrically to device 25 through this means. In the preferred embodiment of the invention, it is preferred to use at least two separately positioned anode wires for electrically conductive means 65. Accordingly, this requires at least two spacer members within plating device 25. The number of connection means 65 required with device 25 is dependent on the metals or alloys of metals being plated. For example, when plating a precious metal such as gold, it is only preferred to use two spacedly positioned connective means 65. When using a nonprecious metal or alloy such as nickel, it is preferred to use at least five connection means 65 spacedly positioned throughout device 25. Again, wire 11 is illustrated in its preferred position within member 43.

Figure 7:
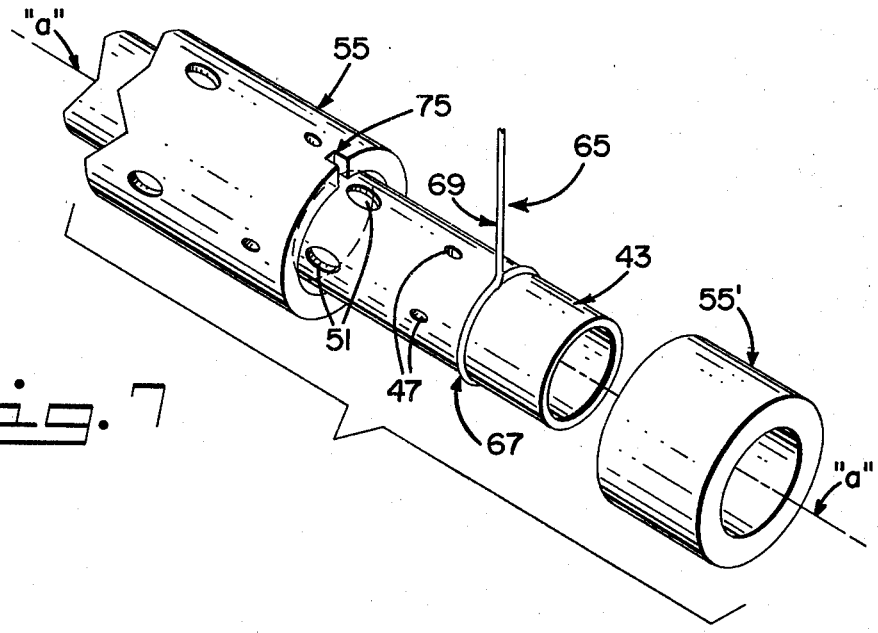
FIG. 7 is an isometric view of a preferred embodiment of the electrically conductive means of the present invention.

FIG. 7 illustrates the preferred positioning relationship of electrical connection means 65 about tubular conductive means 43. Additionally, there is illustrated the positioning relationship of supportive member 55. Located within member 55 is a predefined notched portion 75 which serves to house the upstanding end portion 69 of conductive means 65. The encircling end portion 67 of connective means 65 is positioned in engaged relationship about tubular member 49. Accordingly, the notched portion of supportive member 55 slides over encircling portion 67. This is achieved as a result of the notched portion of member 55 having a smaller internal diameter which maintains engaged relationship with tubular member 49. Once the connective means 65 is positioned in this manner, the remaining unnotched portion of supportive member 55 (illustrated as 55') is positioned in engaged end-to-end relationship with the foredescribed notched portion. Additionally, a sealant or similar cementing compound is utilized to provide a secured engagement of these two members. Also illustrated in FIG. 7 are the spacedly positioned entrance ports 47 and exit ports 51. Also illustrated are the corresponding ports within the described supportive member 55 which align with the forementioned entrance and exit ports within the conductive member 49. The centrally located axis (*a*) of tubular conductive member 49 is also shown. As has been described, it is along this central axis that the wire to be plated passes through the electroplating device 25.

Figure 8:
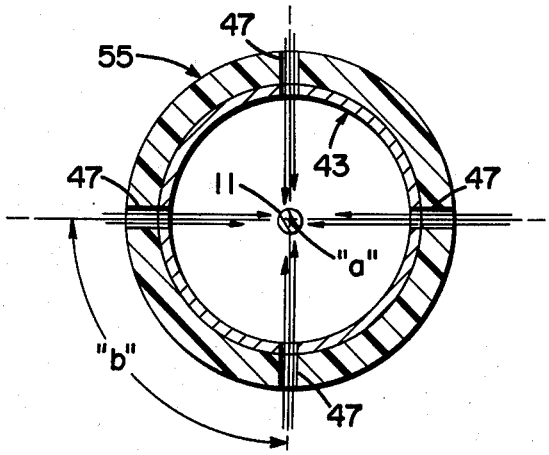
FIG. 8 illustrates the manner in which electrolyte solution is distributed against the moving wire within the device of the present invention.

In FIG. 8, taken along the line 8—8 in FIG. 2, an enlarged more detailed view of the supportive member 55 with tubular electrically conductive member 43 positioned therein is provided. The remaining portions of electroplating device 25 have been deleted for purposes of clarity. As illustrated, the electrolyte solution enters tubular member 43 through the four entrance ports 47 to be distributed against the substantially centrally located wire 11. As also previously described, each of the entrance ports 47 are positioned at approximately 90° (angle *b*) from each other with respect to the central axis *a*. Thus, wire 11 is struck about its entire cross sectional periphery by a uniform distribution of incoming electrolyte solution. The solution is distributed against the wire in the directions indicated by the arrows in FIG. 8.

Figure 9:
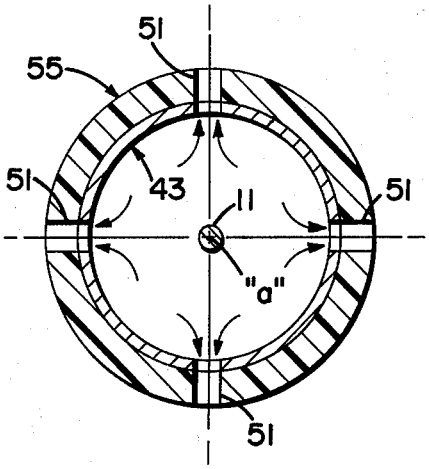
FIG. 9 illustrates the manner in which electrolyte is removed from within the electrically conductive means of the present invention.

In FIG. 9, taken along the line 9—9 in FIG. 2, one of the arrays of exit ports 51 is shown. Similar to the array of entrance ports in FIG. 8, each of the exit ports 51 is positioned at approximately 90° from each other with respect to the central axis *a*. Accordingly, rapid removal of the electrolyte solution within the tubular conductive member 43 is facilitated. It is again important to note that although a supportive means 55 having a plurality of openings therein corresponding to the openings within tubular conductive member 43 is shown, this is not an essential component in the present invention. That is, member 55 could be entirely removed from within device 25 and a substantially enlarged conductive tubular member 43 used instead. However, utilization of a supportive member 55 is preferred to therefore provide a means whereby a substantially smaller tubular conductive member 43 can be used.

As previously mentioned, a device substantially similar in construction to plating device 25 is capable of performing additional functions relating to electroplating processes. For example, device 25 could easily be connected to a suitable cleansing material and therefore serve as a means for cleaning contaminants from wire 11 prior to the electroplating step. Accordingly, two devices can be successfully used in the system of FIG. 1, one providing the cleaning function with the other providing the described electroplating.

Still further, device 25 could easily be adapted for providing the described rinsing function in system 10. As with the cleaning step, device 25 could be connected to the necessary rinsing solutions and serve to rinse wire 11 after completion of the electroplating step.

Thus, an additional feature of device 25 has been provided as a result of the device not only being capable of uniform electroplating a moving wire but also being capable of uniformly cleaning and rinsing the wire as well.

Thus there has been shown and described an apparatus and method for electroplating a moving wire. The device and method described are capable of electroplating said wire using substantially higher plating rates than heretofore known in the prior art.

While there has been shown and described what are at present considered the preferred embodiments of the invention, it will be obvious to those skilled in the art that various changes and modifications may be made therein without departing from the scope of the invention as defined by the appended claims.

What is claimed is:

1. A device for electroplating a wire established at a negative electrical potential and moving along an established path, said device adapted for being supplied electrolyte and comprising:

a housing of electrically insulative material including a common passageway for having said wire move therethrough and first and second manifold means, said first manifold means including a plurality of spacedly positioned inlet means each having access to said common passageway for providing said passageway with said electrolyte, said second manifold means including a plurality of spacedly positioned outlet means intermittently oriented in said housing with respect to said inlet means, each of said outlet means having access to said common passageway for removing electrolyte from therein; and electrically conductive means positioned within said common passageway and about said established path of movement of said wire for providing said electrolyte with a positive electrical potential, said conductive means including therein a plurality of arrays of entrance ports and a plurality of arrays of exit portions, each of said arrays of entrance ports aligning with each of said inlet means for receiving said electrolyte and for distributing said electrolyte against said wire in a substantially uniform manner, each of said arrays of exit ports aligning with each of said outlet means for passing said electrolyte from within said electrically conductive means to said second manifold means, each of said exit ports larger than each of said entrance ports.

2. The device according to claim 1 wherein each of said inlet means of said first manifold means comprises a substantially circular passage located about said common passageway.

3. The device according to claim 1 wherein each of said outlet means of said second manifold means comprises a substantially circular channel located about said common passageway.

4. The device according to claim 1 wherein said electrically conductive means comprises a tubular metallic member having a central axis coincidental to said established path of travel of said moving wire.

5. The device according to claim 4 wherein the number of said entrance ports within each of said arrays of entrance ports is four, each of said entrance ports within each array positioned substantially at right angles from each other with respect to said central axis.

6. The device according to claim 4 wherein the number of said exit ports within each of said arrays of exit ports is four, each of said exit ports within each array positioned substantially at right angles from each other with respect to said central axis.

7. The device according to claim 4 wherein said tubular metallic member is comprised of platinum.

8. The device according to claim 1 further including electrically insulative supportive means positioned within said common passageway and about said electrically conductive means for supporting said electrically conductive means within said passageway.

9. The device according to claim 1 further including electrical connection means having first and second opposing end portions, said first end portion electrically joined to said electrically conductive means, said second end portion adapted for being positioned externally of said housing and for being electrically connected to an external power source.

10. The device according to claim 9 wherein said electrical connection means comprises at least two spacedly positioned wires.

11. A method for electroplating a wire established at a negative electrical potential and moving through a device including a housing having a common passageway therein and an electrically conductive means located within said common passageway and including therein a plurality of arrays of entrance ports and a plurality of arrays of exit ports intermittently oriented in said housing with respect to said arrays of entrance ports, each of said exit ports larger than each of said entrance ports, said method comprising:

moving said wire through said electrically conductive means;

supplying said device with a continuous flow of electrolyte, said electrolyte passing through each of said arrays of entrance ports to enter said electrically conductive means and strike said wire moving through said conductive means;

applying electrical energy to said electrically conductive means in a manner that said electrolyte within said electrically conductive means is at a positive electrical potential; and removing said electrolyte within said electrically conductive means by passing said electrolyte through each of said arrays of exit ports.

12. The method according to claim 11 wherein said wire is moved through said electrically conductive means at a rate within the range of from about 200 to about 400 feet per minute.

13. The method according to claim 12 wherein the current densities utilized within said device are within the range of from about 1,000 to about 12,000 amps per square foot of wire within said device.

14. The method according to claim 11 wherein said continuous flow of electrolyte is supplied said device at a pressure of from about 20 to about 40 pounds per square inch.

* * * * *